US007621651B2

(12) United States Patent
Chan et al.

(10) Patent No.: US 7,621,651 B2
(45) Date of Patent: Nov. 24, 2009

(54) DECORATIVE PICTURE MIRROR

(75) Inventors: Po Kwok Chan, Hong Kong (CN); Chung Ki Yim, Hong Kong (CN)

(73) Assignee: World Fancy Limited, Hong Kong (CN)

( * ) Notice: Subject to any disclaimer, the term of this patent is extended or adjusted under 35 U.S.C. 154(b) by 130 days.

(21) Appl. No.: 11/856,710

(22) Filed: Sep. 17, 2007

(65) Prior Publication Data

US 2008/0068828 A1 Mar. 20, 2008

(30) Foreign Application Priority Data

Sep. 20, 2006 (CN) ..... 2006 2 0136681 U

(51) Int. Cl.
*F21V 33/00* (2006.01)

(52) U.S. Cl. ..... 362/135; 362/140; 362/84; 362/806; 359/884; 428/48

(58) Field of Classification Search ..... 362/135, 362/140, 84, 806; 359/883, 884, 839; 428/47–48; 40/406

See application file for complete search history.

(56) References Cited

U.S. PATENT DOCUMENTS 3,884,559 A * 5/1975 Baba ..... 359/884
4,123,578 A * 10/1978 Perrington et al. ..... 428/206
4,129,971 A * 12/1978 Reusser ..... 52/288.1
4,199,358 A * 4/1980 Parsons ..... 430/308
5,470,623 A * 11/1995 Lucas ..... 428/47
5,979,096 A * 11/1999 Ferdinandsen et al. ..... 40/768

* cited by examiner

*Primary Examiner*—Ali Alavi
(74) *Attorney, Agent, or Firm*—Dovas Law, P.C.

(57) ABSTRACT

A decorative picture mirror is provided. The picture mirror includes a smooth mirror surface. A coating layer is provided on a back portion of the mirror surface, wherein the coating layer covers a select local part of the backside of the mirror surface leaving an uncovered portion of the backside of the mirror surface. A medium including a graphic pattern is connected to the backside of the mirror surface, wherein the graphic pattern substantially fully covers the uncovered portion of the backside of the mirror surface, whereby the coating layer and the graphic pattern form substantially continuous coverage on the select local part of the backside of the mirror surface.

17 Claims, 3 Drawing Sheets

DECORATIVE PICTURE MIRROR

FIELD OF INVENTION

The present invention relates to a mirror. More particularly, the present invention relates to a type of mirror with decoration functionality.

BACKGROUND

As an everyday article, mirrors have had a monotonous function over the past years, only used as a tool for people to decorate themselves, used for people to check their appearance and cosmetics, and used for interior decoration.

With the improvement of people's esthetic judgment, more and more people realize the decoration function of the mirror; as a result, in some places the mirror is sprayed with a pattern or the pattern is directly drawn onto the mirror glass, so that the mirror has an esthetic effect.

Also, some people design the decoration frame of the mirror into various forms, e.g. a dancing fairy lady and an extended branch, used as the mirror decoration.

All of these methods have extended the original function of the mirror, making it decorative. However, as for the first method discussed above, since the pattern is covering the mirror surface, the pattern may easily fall off during cleaning, and the color will change with time, so the useful product life is normally very short. As for the second method discussed above, the decoration effect is neither pronounced nor especially noticeable or attention getting.

In view of the above, there is a need for a mirror design having an improved decorative effect.

SUMMARY

In view of the above problems, It is a primary object of the present invention is to provide one decorative picture mirror, which not only has mirror function, but also has outstanding decoration effect, capable of being used for various decoration and promotion places.

It is another primary object of the present invention to provide one decorative picture mirror. This mirror adopts the existing process to divide the mirror surface and form several parts, so that the mirror surface has several functions, thus having extensive promotion and decoration function, capable of being used in various environments.

The present invention is realized as follows:

A decorative picture mirror, including mirror surface and coating. The exterior surface of the mirror is smooth, which features that the backside of the mirror is covered with coating layer, and the coating layer is set at the local part of the mirror instead of fully covering the backside of the mirror. The backside of the mirror also has graphic pattern, which is set at the local part of the mirror backside, forming full coverage on the mirror backside together with the coating layer.

The graphic pattern is pasted and coated to the backside of the mirror, or covered onto the backside of the mirror in the form of attached to other carrier (e.g. paper).

The carrier can be graphic paper, photo, film and even adhesive layer (directly printed onto the backside of the mirror through digital printer).

For the decorative picture mirror described, the mirror surface is of regular geometrical shape and can also be designed into special shape, e.g. concave mirror, based on the applied place and user's needs.

The mirror surface described can be a glass or plastic product.

For a better decoration effect, the outer edge of this decorative picture mirror can be installed with frame covering the edge of the mirror surface, which can protect the coating layer and pattern and prevent the mirror surface from scratching people and other articles.

This invention adopts the above structure, dividing the original simple mirror into patterns, so that the mirror has multifunctional applications. The pattern reflected through coating layer provides a sense of stereoscopic vision, more outstanding than the planar pattern, with better visual effect. So in addition to the existing mirror function, this mirror also has outstanding decoration and promotion function, and can be widely used in varying environments and meeting various needs.

This invention has a simple fabrication process and large pattern variability. This invention is esthetic and practical, the picture mirror being able to be hung on a wall or placed onto a horizontal surface.

BRIEF DESCRIPTION OF THE DRAWINGS

The decorative picture mirror is further described with reference to the accompanying drawings in which.

DETAILED DESCRIPTION OF THE PREFERRED EMBODIMENTS

The detailed implementation of the present invention is described below with reference to FIG. 1, FIG. 2, FIG. 3 and FIG. 4.

The further detailed description is made below for the technical scheme of this invention through a preferred embodiment and in combination with the enclosed diagrams. However, the preferred embodiment of this invention is not limited to this.

Figure 1:
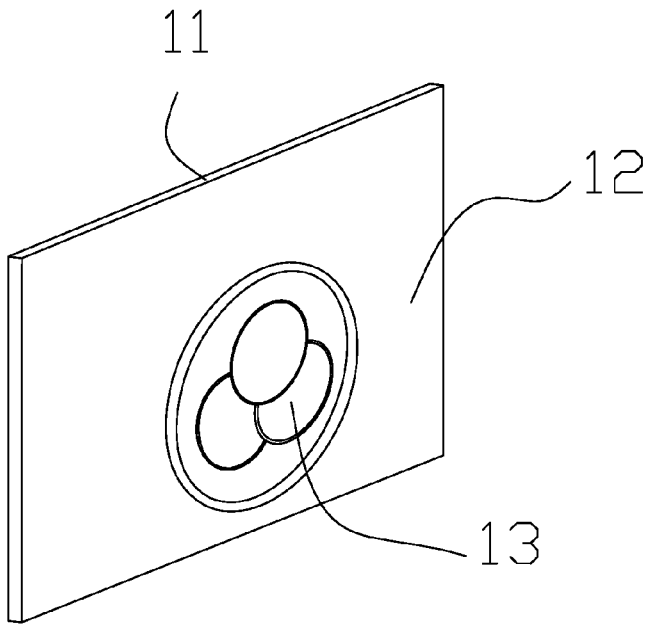
FIG. 1 is an isometric view of a decorative picture mirror according to a preferred embodiment of the present invention.
Figure 2:
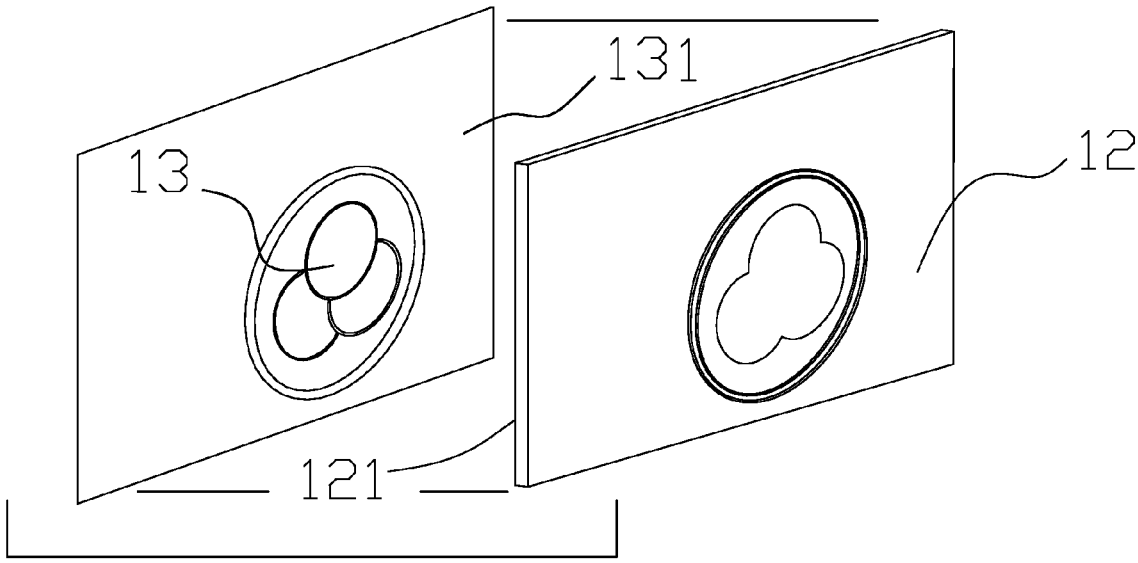
FIG. 2 is an isometric exploded view of the decorative picture mirror of FIG. 1.

In FIG. 1 & FIG. 2, shown is a frame 11, a mirror surface 12, and a graphic pattern 13. The mirror surface 12 is preferably glass or plastic. The graphic pattern 13 preferably includes paint and/or other suitable medium. The frame 11 is of frame construction, covering the outer edge of the mirror surface 12; the backside of the mirror surface 12 has a mercury reflective coating 121, which covers a select local part of the backside of the mirror surface 12, leaving an uncovered portion of the backside of the mirror surface for the graphic pattern 13 to show through. The graphic pattern 13 is preferably set on an independent carrier paper 131, covering the backside of the mirror surface 12 using a pasting method, and the portion of the mirror surface 12 covered with the painting of the graphic pattern 13 is different from the coverage of the mercury reflective coating 121. The combination of the graphic pattern 13 and the mercury reflective coating 121 preferably fully covers the backside of the mirror surface 12.

The mercury reflective coating 121 can be substituted with another reflective coating including but not limited to a silver coating, an aluminum coating, and a copper coating.

The mirror surface 12 is laid inside the frame 11, where the graphic pattern 13 is covered by frame 11 together with mirror surface 12. Seen from the appearance, the mercury reflective coating 121 at the backside of mirror surface 12 corresponds to an area where the graphic pattern 13 is removed, or in other words the place that is planned to display the graphic pattern 13 will not be coated with mercury. So through set-off by the mercury reflective coating 121, the graphic pattern 13 can be displayed clearly and prominently.

Of course, the graphic pattern 13 can be designed into various patterns based on the actual needs, and the mercury reflective coating 121 can also be designed based on the size of graphic pattern 13 to meet the needs of setting off the graphic pattern 13.

Figure 3:
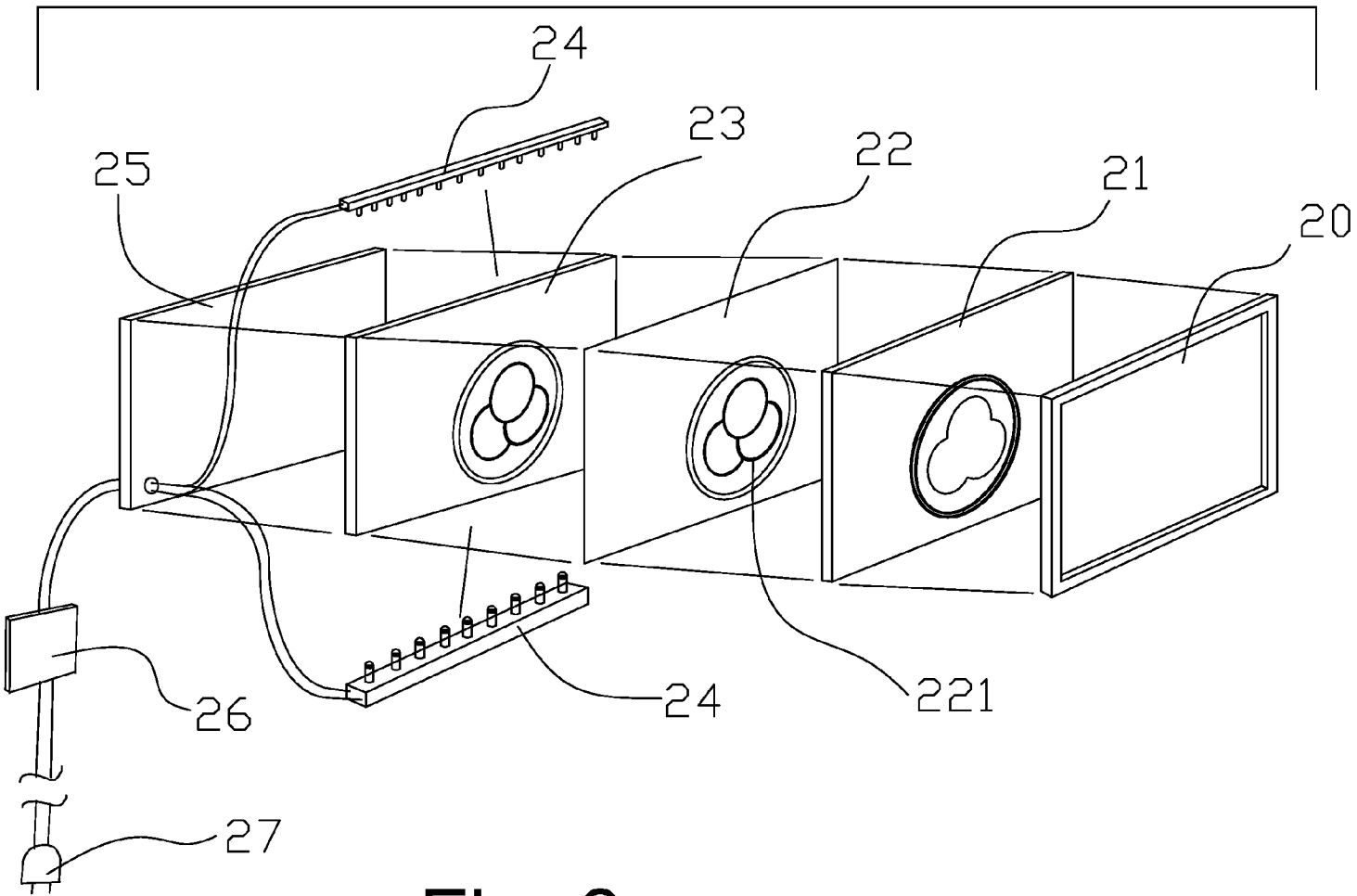
FIG. 3 is an isometric exploded view of a decorative picture mirror according to another preferred embodiment of the present invention.

FIG. 3 is the structural breakdown schematic diagram for another preferred embodiment, which is further improved based on the FIG. 1 so as to have better decoration effect.

As shown in FIG. 3, a frame 20 is beset with a glass mirror 21, in which the backside of glass mirror 21 is coated with mercury. The mercury reflective coating is engraved to leave a blank space, where a pattern 221 is set up. The pattern 221 is presented on a euphotic film 22 as the carrier, the pattern 221 being attached to the film 22, and matching the blank space in the mercury reflective coating on the glass mirror 21. The film 22 is further covered with a polymeric sheet which is preferably an acrylic sheet 23. The acrylic sheet 23 is preferably 4-5 mm thick and carved with a shape corresponding to and aligned with the pattern 221, capable of providing a good refraction effect through light refraction, making the image have a stereoscopic appearance.

The general thickness of film 22 is preferably only 0.1 mm.

The upper and lower ends of the backside of acrylic sheet 23 is installed with LEDs 24, which are arranged in sequence, forming an R, G & B tricolor light band. Through the control of a controller 26, the acrylic sheet 23 may be irradiated with the R, G & B tricolor light band and can flash continuously. Together with the refraction effect of the acrylic sheet 23, the decoration function of the pattern becomes more pronounced.

The LEDs 24 are connected with the controller 26 via wire, with power supply provided through a power plug 27, and the wire is led from the lower part of a frame base plate 25.

The frame base plate 25 covers the LEDs 24 and the acrylic sheet 23. The frame base plate 25 and the frame 20 accommodate the glass mirror 21, film 22, acrylic sheet 23 and LEDs 24 inside, forming a complete mirror that can be used for display and promotion.

In the embodiment shown in FIG. 3, the LEDs are laid in a transverse direction. Alternatively, in other methods, LEDs can be laid in a longitudinal direction or a combination of both transverse and longitudinal directions.

Figure 4:
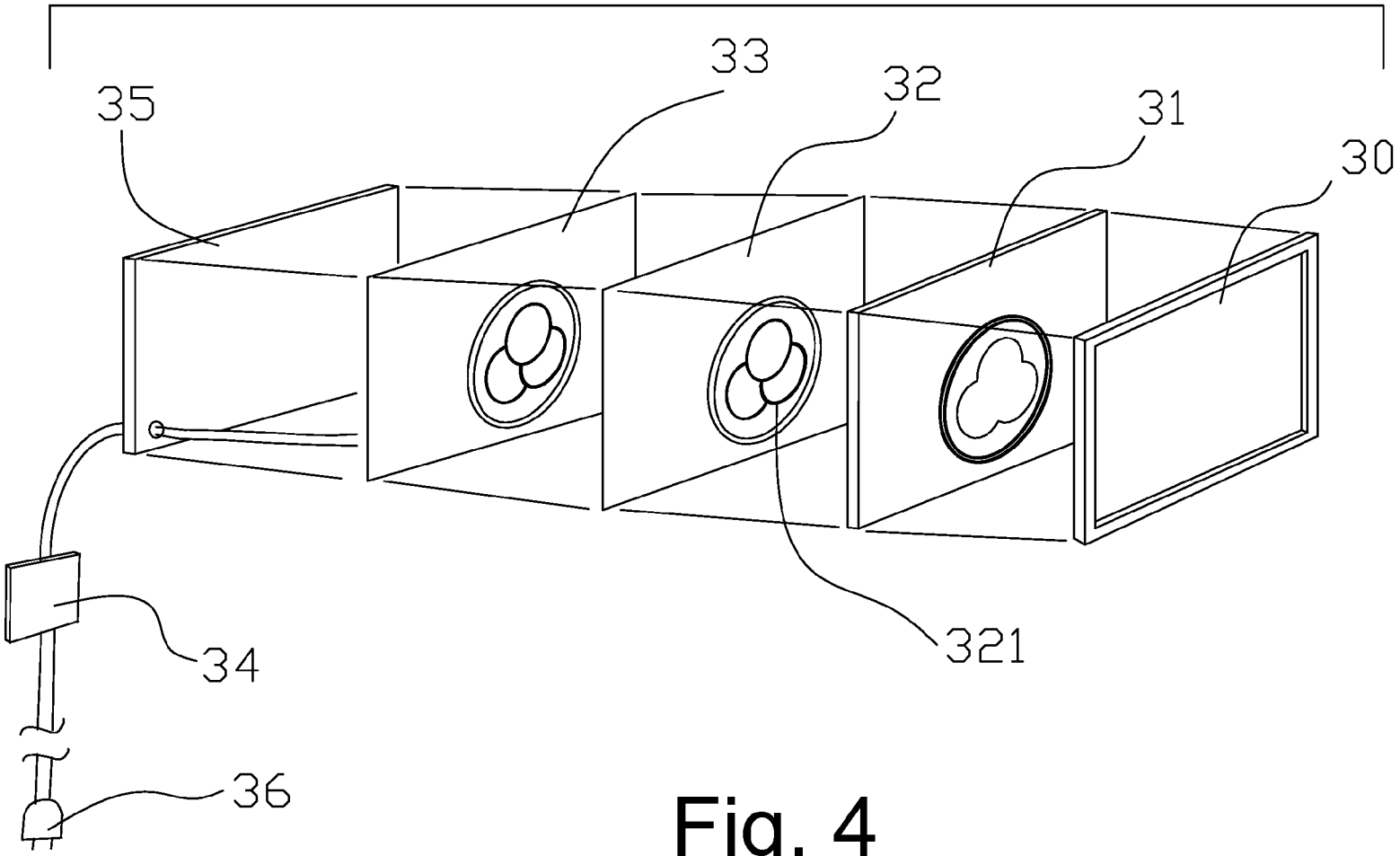
FIG. 4 is an isometric exploded view of a decorative picture mirror according to yet another preferred embodiment of the present invention.

FIG. 4 shows a structural breakdown schematic diagram of another preferred embodiment, and this preferred embodiment reflects the decoration effect of this invention in another form of expression.

As shown in the FIG. 4, a frame 30 is beset with glass mirror 31, in which the backside of the glass mirror 31 is coated with mercury. The mercury reflective coating is engraved to leave a blank space where a pattern 321 may show through. The pattern 321 is presented on a euphotic film 32 as a carrier, the pattern 321 being attached to the film 32, and matching the blank space in the mercury reflective coating on the glass mirror 31. The film 32 is further covered with electro-luminescent sheet 33 (EL sheet), and the EL sheet 33 adopts electro-luminescent powder or electric circuit to draw the pattern shape so as to match the pattern part. After the power is switched on, the EL sheet 33 emits light, making the pattern more outstanding, with a pronounced effect of display and promotion.

The EL sheet 33 is connected with a power supply 36 through a controller 34; the controller 34 controls an illumination time and intensity of the EL sheet 33 so as to have different visual effects.

A frame base plate 35 covers the EL sheet 33, and the frame base plate 35 and the frame 30 accommodate the glass mirror 31, film 32 and the EL sheet 33 inside, forming a complete mirror that can be used for display and promotion.

The preferred embodiments are described above to best illustrate the function, components, steps, and controls of the present invention. The present invention is not limited to the embodiments described, but many variations and modifications are within the scope of the claims of the invention.

We claim:

1. A decorative picture mirror comprising:

a smooth mirror surface;

a coating layer on a back portion of the mirror surface, wherein the coating layer covers a select local part of the backside of the mirror surface leaving at least one uncovered portion of the backside of the mirror surface;

a medium comprising a graphic pattern connected to the backside of the mirror surface, wherein the graphic pattern substantially fully covers the at least one uncovered portion of the backside of the mirror surface, whereby the coating layer and the graphic pattern form substantially continuous coverage on the select local part of the backside of the mirror surface;

a polymeric sheet connected to the mirror surface over the coating layer and over the medium comprising the graphic pattern; and at least one LED connected to the polymeric sheet for emitting light through the polymeric sheet.

2. The mirror according to claim 1, wherein the medium comprises a carrier which is at least one of pasted to the backside of the mirror surface, coated to the backside of the mirror surface, and covered onto the backside of the mirror surface.

3. The mirror according to claim 2, wherein the carrier comprises at least one of a photo layer, a film layer and an adhesive layer.

4. The mirror according to claim 1, wherein the medium comprises a euphotic film.

5. The mirror according to claim 1, wherein the medium comprises paint.

6. The mirror according to claim 1, wherein the mirror surface is shaped as at least one of rectangular, circular, and triangular.

7. The mirror according to claim 1, wherein the mirror surface is designed as a 3D construction.

8. The mirror according to claim 1, wherein the mirror surface is at least one of glass and plastic.

9. The mirror according to claim 1, further comprising a frame covering at least one edge of the mirror surface.

10. The mirror surface according to claim 1, wherein the polymeric sheet is carved with a shape corresponding to and aligned with the graphic pattern.

11. The mirror according to claim 1, wherein the polymeric sheet is an acrylic sheet.

12. The mirror according to claim 1, further comprising a controller connected to the at least one LED.

13. The mirror according to claim 1, wherein the at least one LED comprises a plurality of LEDs selectively arranged on a perimeter of the polymeric sheet on a side of the polymeric sheet opposite the coating layer and the medium comprising the graphic pattern.

14. The mirror according to claim 1, wherein the at least one LED comprises a plurality of LEDs selectively arranged on a side of the polymeric sheet opposite the coating layer and the medium comprising the graphic pattern.

15. The mirror according to claim 1, wherein the at least one LED comprises a plurality of LEDs arranged in sequence, forming an R, G & B tricolor light band.

16. A decorative picture mirror comprising:

a smooth mirror surface;

a coating layer on a back portion of the mirror surface, wherein the coating layer covers a select local part of the backside of the mirror surface leaving at least one uncovered portion of the backside of the mirror surface;

a medium comprising a graphic pattern connected to the backside of the mirror surface, wherein the graphic pattern substantially fully covers the at least one uncovered portion of the backside of the mirror surface, whereby the coating layer and the graphic pattern form substantially continuous coverage on the select local part of the backside of the mirror surface;

an electro-luminescent sheet connected to the mirror surface over the coating layer and over the medium comprising the graphic pattern; and a power supply connected to the electro-luminescent sheet.

17. The mirror according to claim 16, further comprising a controller connected to the electro-luminescent sheet.

* * * * *